US006659804B2

(12) United States Patent
Nishio et al.

(10) Patent No.: US 6,659,804 B2
(45) Date of Patent: Dec. 9, 2003

(54) MULTI-CONTACT CONNECTOR

(75) Inventors: Atsushi Nishio, Ibaraki (JP); Katsuhiro Hori, Ibaraki (JP); Fumihiro Hosoya, Ibaraki (JP)

(73) Assignee: Mitsumi Electronic Co., LTD (JP)

( * ) Notice: Subject to any disclaimer, the term of this patent is extended or adjusted under 35 U.S.C. 154(b) by 0 days.

(21) Appl. No.: 10/113,128

(22) Filed: Mar. 29, 2002

(65) Prior Publication Data

US 2002/0142666 A1 Oct. 3, 2002

(30) Foreign Application Priority Data

Mar. 30, 2001 (JP) ..... 2001-097990

(51) Int. Cl.[7] ..... H01R 24/00
(52) U.S. Cl. ..... 439/660; 439/604; 439/733.1
(58) Field of Search ..... 439/660, 604, 439/733.1

(56) References Cited

U.S. PATENT DOCUMENTS 5,380,225 A * 1/1995 Inaoka ..... 439/284
5,785,557 A * 7/1998 Davis ..... 439/660
5,879,196 A * 3/1999 Lee ..... 439/604
6,099,359 A * 8/2000 Yamamuro ..... 439/660
6,106,338 A * 8/2000 Wu et al. ..... 439/660
6,129,589 A * 10/2000 Simmel et al. ..... 439/660
6,309,255 B1 * 10/2001 Yu ..... 439/101
6,371,771 B1 * 4/2002 Fan ..... 439/607

* cited by examiner

*Primary Examiner*—P. Austin Bradley
*Assistant Examiner*—Edwin A. León
(74) *Attorney, Agent, or Firm*—Patents & TMS, P.C.

(57) ABSTRACT

A connector in which it is possible to prevent its contact from being disengaged or displaced from a groove of a contact holding member includes a shielding cover, a plurality of contacts (terminals) arranged inside the shielding cover, and a contact holding member for holding the contacts inside the shielding cover. The contact holding member is formed with a plurality of grooves, and each groove is formed with opposite protruding portions along its longitudinal direction for restricting the movement of the contact in a direction away from a bottom surface of the groove.

4 Claims, 6 Drawing Sheets

MULTI-CONTACT CONNECTOR

BACKGROUND OF THE INVENTION

1. Field of the Invention

The present invention relates to a connector, and in particular relates to a multi-contact connector which transmits and receives electric signals and supplies power, and the like by being connected to a mated connector.

2. Description of the Prior Art

A conventional multi-contact connector is generally comprised of a shielding cover (or housing), a plurality of contacts (terminals) arranged inside the shielding cover, and a contact holding member which is formed with a plurality of grooves for holding the contacts inside the shielding cover.

FIG. 6 is a cross-sectional view which shows a state that one of the contacts 40 is held in a groove 53 formed in the contact holding member 50 of the conventional connector.

The contact 40 used in this conventional connector is formed by punching out a thin metal plate so as to be an elongated metal strip having a substantially rectangular cross section as shown in FIG. 6. The top surface of the contact 40 forms an electrical contact surface 41 which makes contact with a contact provided in a mated connector.

Further, as described above, the contact holding member 50 is formed with a plurality of grooves 53. As shown in FIG. 6, each groove 53 is defined by a bottom surface 51 and side surfaces 52 that are substantially perpendicular to the bottom surface 51, and the contact 40 is held inside the groove 53.

In such a conventional connector, both end portions of each contact 40 in the longitudinal direction thereof, that is, the tip end portion and the base end portion of the contact 40 (not shown in the drawings) are held by the contact holding member 50. However, as shown in FIG. 6, the main body portion of the contact 40, that is the middle portion other than the tip and base end portions thereof is merely placed inside the groove 53 of the contact holding member 50, so that both sides of the middle portion of the contact 40 are not held by the contact holding member 50.

As a result, in the conventional connector having such contact and contact holding member, there is a case that the main body portion of the contact 40 will rise upwardly as shown by the dotted lines in FIG. 6 to be disengaged or displaced from the groove 53 due to an external force being applied to the contact 40 when the contact 40 makes contact with a contact of a mated connector, for example.

SUMMARY OF THE INVENTION

In view of the above problem, it is an object of the present invention to provide a connector in which it is possible to prevent its contact from being disengaged or displaced from a groove of a contact holding member.

In order to achieve the object mentioned above, the present invention is directed to a connector which comprises at least one contact; a contact holding member having at least one groove in which the contact is held, the groove having a bottom surface, and restriction means for restricting the movement of the contact in a direction away from the bottom surface of the groove.

In this invention, it is preferred that the restriction means is provided at both sides of the groove.

Further, it is also preferred that the restriction means includes a pair of protruding portions which are formed in the both sides of the groove, respectively, and provided in at least a part of the groove in which the middle portion of the contact is placed. In this case, it is preferred that the protruding portions extend along the longitudinal direction of the groove.

Furthermore, in the present invention, it is preferred that the maximum width of the contact is larger than the interval between both the protruding portions.

Moreover, it is also preferred that the contact is held in the groove in a state that the contact abuts on the protruding portions and the bottom surface of the groove.

Moreover, it is also preferred that the contact has both side surfaces which abut on the protruding portions.

Moreover, it is also preferred that the contact includes a contact surface which is partially exposed from an opening between the protruding portions of the groove.

As has been described, the connector according to the present invention has a structure in that the movement of the contact is restricted by the abutment between the abutment surfaces of the contact and the abutment surfaces of the protruding portions. Therefore, there is no possibility that the contact will be displaced or disengaged from the groove even in the case where an external force is applied to the contact due to the contact with a contact of a mated connector.

These and other objects, structures and advantages of the present invention will be apparent from the following description of the preferred embodiment when it is considered taken in conjunction with the appended drawings.

DETAILED DESCRIPTION OF THE INVENTION

Hereinbelow, preferred embodiments of the present invention will be described in detail with reference to the accompanying drawings.

Figure 1:
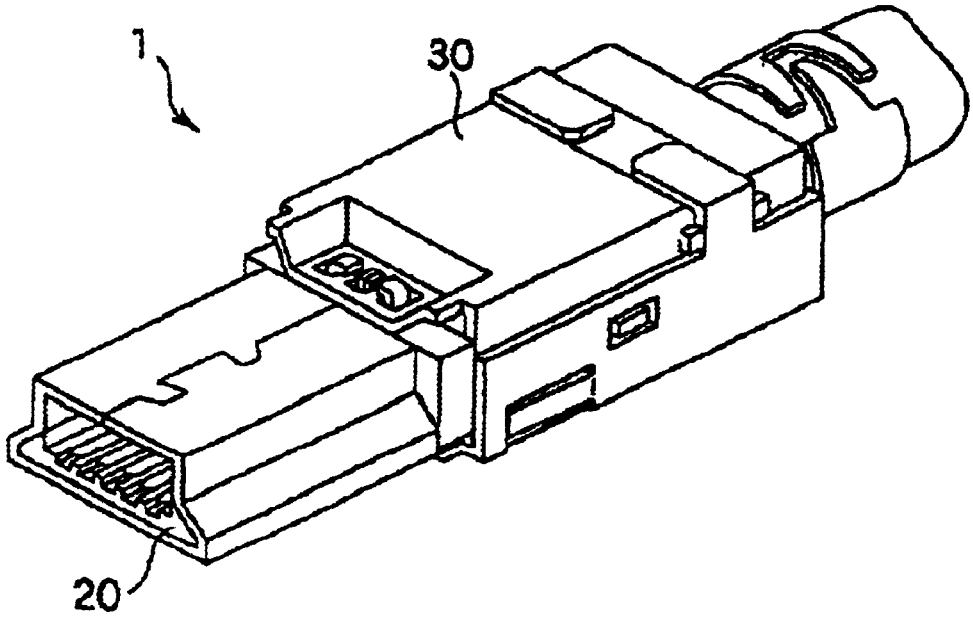
FIG. 1 is a perspective view which shows the overall structure of the connector according to the present invention.
Figure 2:
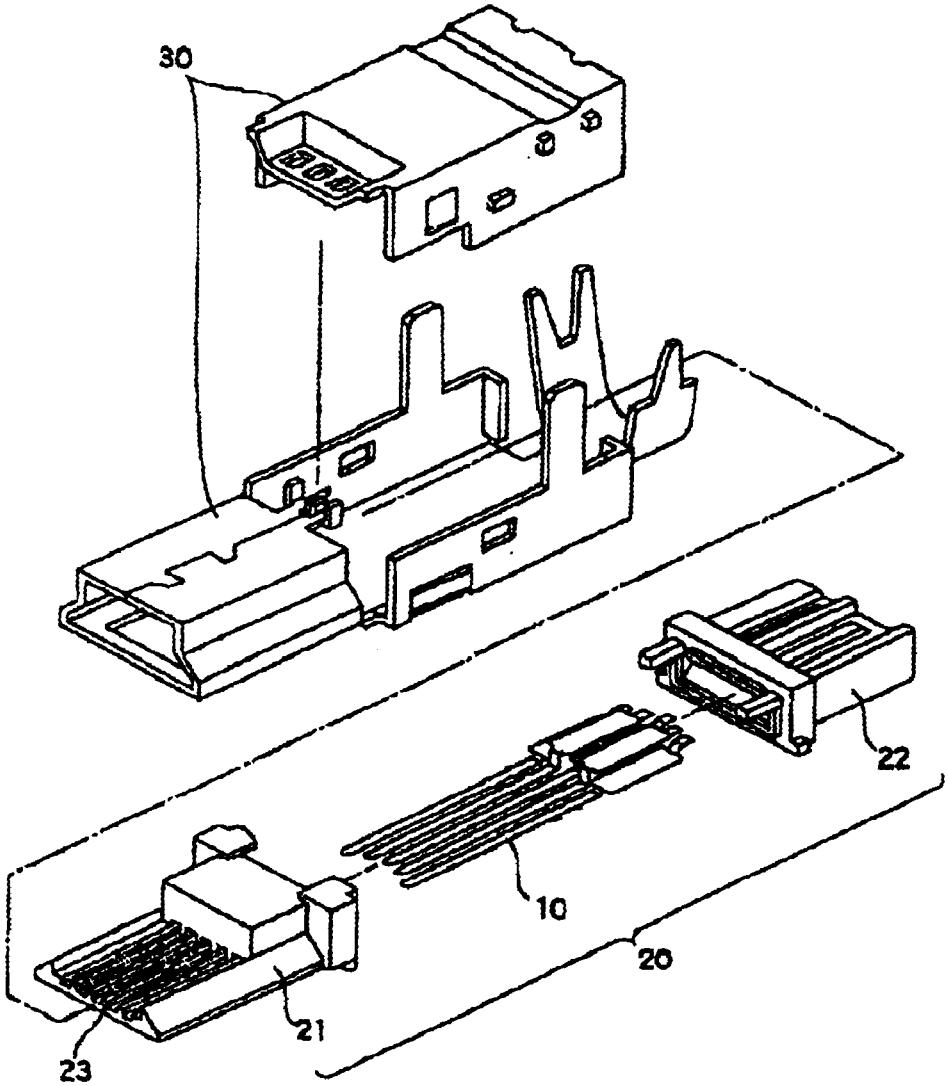
FIG. 2 is an exploded view of the connector of the present invention.

FIG. 1 is a perspective view which shows the overall structure of a connector according to the present invention. FIG. 2 is an exploded perspective view of the connector.

The connector 1 shown in these drawing is a connector plug such as a multi-contact connector plug which is to be connected to a mated connector or receptacle (not shown in the drawings). In this regard, however, it is to be noted that the present invention is not limited to such a connector plug and the present invention can be applied to various connector having contacts and a contact holding member formed with grooves for holding the contacts.

As shown in FIGS. 1 and 2, the connector 1 includes a shielding cover 30, a plurality of contacts (terminals) 10 arranged inside the shielding cover 30, and a contact holding member 20 for holding the contacts 10 inside the shielding cover 30.

The shielding cover 30 is a tubular member formed of metal and has a function of shielding noise generated from the contacts 10.

As shown in FIG. 2, the contacts 10 are arranged side by side inside the connector 1.

As is further shown in FIG. 2, the contact holding member 20 is composed from a front member 21 and a rear member 22. The front member 21 is formed with a plurality of grooves 23 which respectively hold the contacts 10.

Hereinbelow, a detailed description will be made with regard to the contacts 10 and the contact holding member 20 which are the feature of the connector of the present invention.

First, a description will be made with regard to the structure of a connector of a first embodiment of the present invention.

Figure 3:
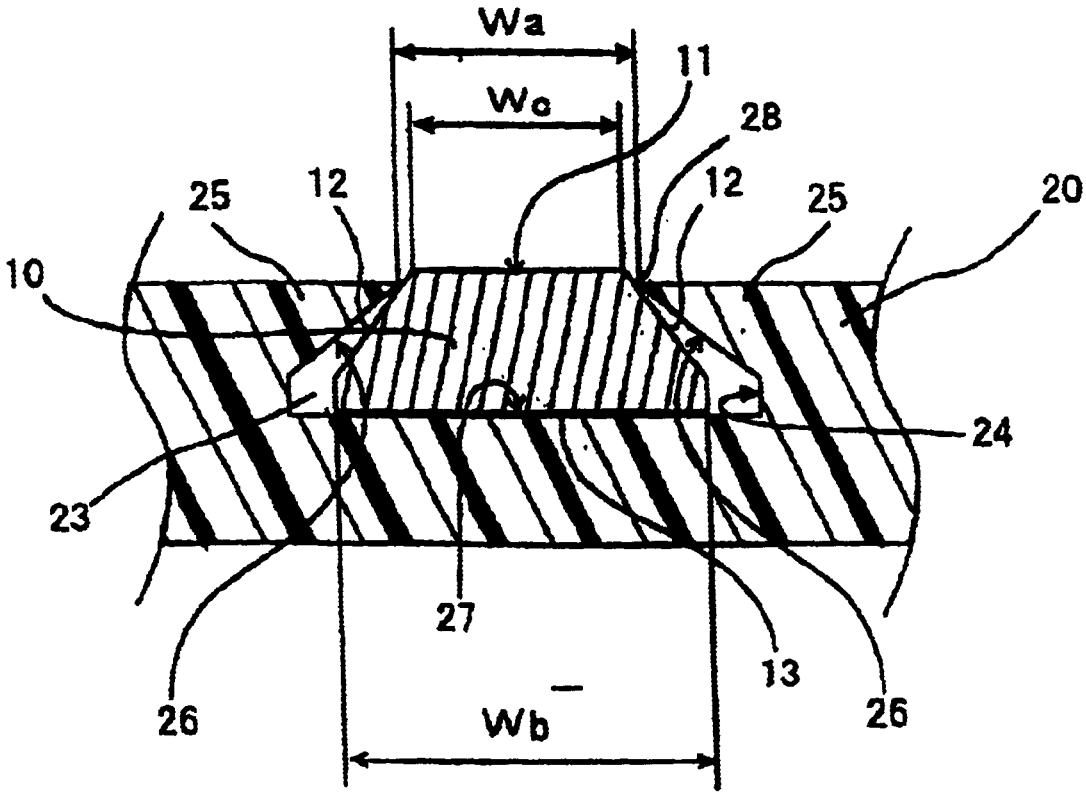
FIG. 3 is a cross-sectional view which shows a state that a contact is held in a groove formed in a contact holding member of a connector of a first embodiment of the present invention.

FIG. 3 is a cross-sectional view which shows a state that a contact 10 is held in a groove 23 formed in a contact holding member 20 of the connector according to the first embodiment of the connector.

As described above, the contact holding member 20 is formed with a plurality of grooves 23, and each groove 23 is defined by a bottom surface 27 and a pair of side surfaces 24,24 provided perpendicularly to the bottom surface 27.

As shown in FIG. 3, in this first embodiment, the groove 23 is formed with protruding portions 25, 25 which protrude toward the inside of the groove 23 so as to form an opening 28 therebetween. These protruding portions 25 are integrally formed on the side surfaces 24, 24 of the groove 23, respectively, and extend along the longitudinal direction of the groove 23. Each of the protruding portions 25, 25 has a substantially triangular cross section (wedged-shape cross section) so as to have an upwardly slanting abutment surface 26 and a planar top surface which forms a continuous surface to the top surface of the contact holding member 20.

As shown in FIG. 3, the contact 10 of this embodiment is formed from an elongated strip having a cross section of a substantially trapezoidal shape so as to have a planar top surface 11 which is a contacting surface, two slanting side surfaces (abutment surfaces) 12, 12 and a bottom surface 13.

The contact 10 is inserted into the groove 23 such that the contacting surface 11 is partially exposed from the opening 28 as shown in FIG. 3.

Further, as shown in FIG. 3, the protruding portions 25, 25 are formed so that the interval Wa therebetween, that is the distance between the tip parts of the protruding portions 25, 25 is smaller than the maximum width Wb of the contact 10, that is the width of the bottom surface 27 thereof. By setting the interval Wa smaller than the maximum width Wb, even in the case where the contact 10 is made to move in a direction away from the bottom surface of the groove 23, the contact 10 is held by the slanting abutment surfaces 26, 26 of the protruding portions (that is, the tip parts of the protruding portions) 25, 25, and this restricts the movement of the contact 10 in a direction away from the bottom surface of the groove 23. In this way, the contact 10 is prevented from being displaced or disengaged from the groove 23 even in the case where an external force is applied thereto.

Further, when the contact 10 is inserted into the groove 23, the contact 10 abuts on the protruding portions 25, 25 and the bottom surface 13 of the contact 10 also abuts on the bottom surface 27 of the groove 23. In this way, since the contact 10 abuts on these three portions described above, it is possible to prevent rattling of the contact 10 within the groove 23, thereby enabling to more stably hold the contact 10 inside the groove 23.

As described above, in this embodiment, the combination of the protruding portions and the contact having the specific shape and size described above constitutes restricting means for restricting the movement of the contact in a direction away from the bottom surface of the groove.

Hereinbelow, a second embodiment and a third embodiment of the connector of the present invention will be described with reference to FIGS. 4 and 5 by focusing on the difference between the first embodiment and each of the second and third embodiments. Further, the description with regard to the same points as those of the first embodiment will be omitted.

Figure 4:
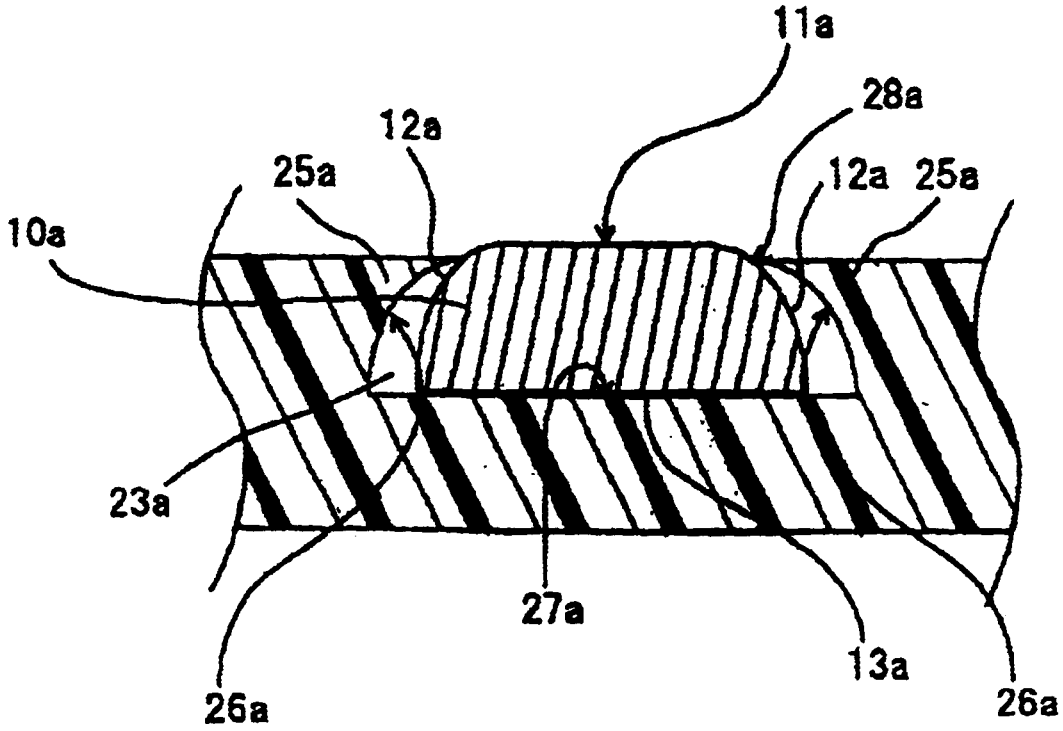
FIG. 4 is a cross-sectional view which shows a state that a contact is held in a groove formed in a contact holding member of a connector of a second embodiment of the present invention.

FIG. 4 is a cross-sectional view which shows a state that a contact is held in a groove of a contact holding member of a connector according to the second embodiment of the present invention.

As shown in FIG. 4, the groove 23*a* of this embodiment is also formed with two protruding portions 25*a*, 25*a* which protrude toward the inside of the groove 23*a* so as to form an opening 28*a* therebetween. These protruding portions 25*a*, 25*a* extend along the longitudinal direction of the groove 23*a*. Each of the protruding portions 25*a*, 25 is defined by a curved abutment surface 26*a* and a planar top surface which forms a continuous surface to the top surface of the contact holding member 20.

As shown in FIG. 4, the contact 10*a* of the second embodiment is also formed from an elongated strip having a cross section of a substantially trapezoidal (semi-circular) shape so as to have a planar top surface 11*a* which is a contacting surface, two curved side surfaces (abutment surfaces) 12*a*, 12*a* and a bottom surface 13*a*.

The contact 10*a* is inserted into the groove 23*a* such that the contacting surface 11*a* is partially exposed from the opening 28*a*. Further, when the contact 10*a* having the above structure is inserted into the groove 23*a*, the curved side surfaces 12*a*, 12*a* of the contact 10*a* are held by the protruding portions (tip parts of the protruding portions) 25*a*, 25*a*, respectively, and the bottom surface 13*a* of the contact 10*a* abuts on the bottom surface 27*a* of the groove 23*a*.

Therefore, in the same manner as the first embodiment, the contact 10*a* is prevented from being displaced or disengaged from the groove 23*a* even in the case where an external force is applied thereto. Further, it is possible to prevent rattling of the contact 10*a* within the groove 23*a*, thereby enabling to more stably hold the contact 10*a* inside the groove 23*a*.

Figure 5:
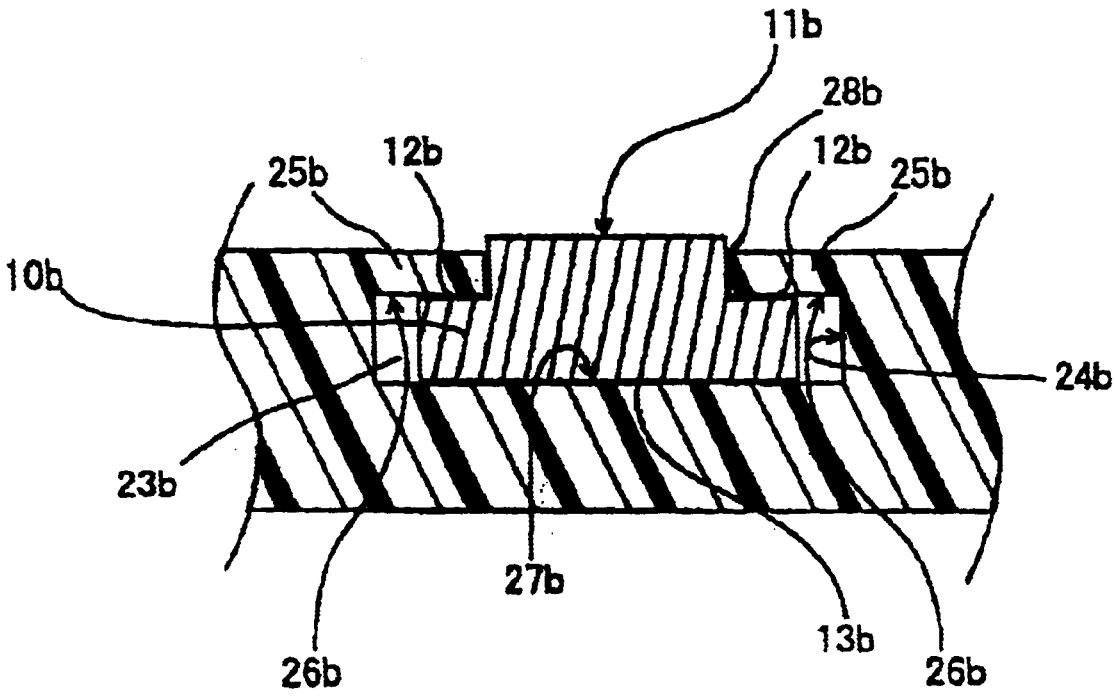
FIG. 5 is a cross-sectional view which shows a state that a contact is held in a groove formed in a contact holding member of a connector of a third embodiment of the present invention.
Figure 6:
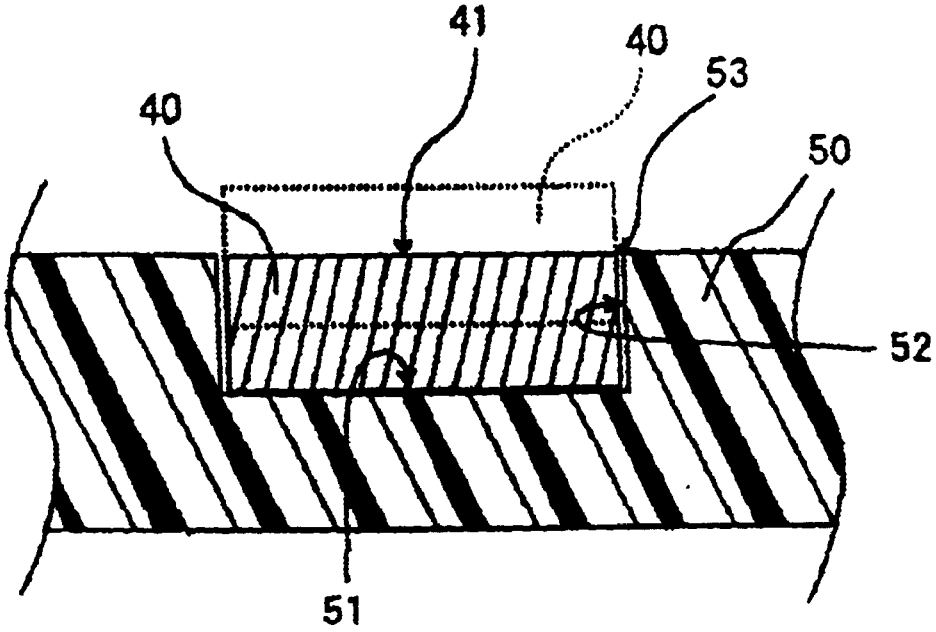
FIG. 6 is a cross-sectional view which shows a state that a contact is placed in a groove of a contact holding member of the conventional connector.

FIG. 5 is a cross-sectional view which shows a state that a contact is held in a groove of a contact holding member of a connector according to the third embodiment of the present invention.

As shown in FIG. 5, the groove 23*b* of this embodiment is also formed with two protruding portions 25*b*, 25*b* which protrude toward the inside of the groove 23*b* so as to form an opening 28*b* therebetween. These protruding portions 25*b*, 25*b* extend along the longitudinal direction of the groove 23*b*. These protruding portions 25*b*, 25*b* are integrally formed on the side surfaces 24*b*, 24*b* of the groove

23*b*, respectively. Each of the protruding portions 25*b*, 25*b* has a substantially rectangular cross section so as to have an under surface 26*b* and a planar top surface which forms a continuous surface to the top surface of the contact holding member 20. The under surfaces 26*b*, 26*b* function as abutment surfaces for holding the contact 10*b*.

As shown in FIG. 5, the contact 10*b* of this third embodiment is also formed from an elongated strip having a cross section of a substantially convex shape so as to have a planar top surface 11*b* which is a contacting surface, left and right step portions each having an abutment surface 12*b* and a bottom surface 13*b*.

The contact 10*b* is inserted into the groove 23*b* such that the contacting surface 11*b* is partially exposed from the opening 28*b*. Further, when the contact 10*b* having the above structure is inserted into the groove 23*b*, the abutment surfaces 12*b*, 12*b* of the left and right step portions of the contact 10*b* are held by the protruding portions (under surfaces 26*b*, 26*b* of the protruding portions) 25*b*, 25*b*, respectively, and the bottom surface 13*b* of the contact 10*b* abuts on the bottom surface 27*b* of the groove 23*b*.

Therefore, in the same manner as the first and second embodiments, the contact 10*b* is prevented from being displaced or disengaged from the groove 23*b* even in the case where an external force is applied thereto. Further, it is possible to prevent rattling of the contact 10*b* within the groove 23*b*, thereby enabling to more stably hold the contact 10*b* inside the groove 23*b*.

In the present invention, the shapes of the abutment surfaces of the contact and the abutment surfaces of the protruding portions are not limited to those of the first to third embodiments, and it is also possible to form these abutment surfaces from various curved surfaces or from a plurality of flat surfaces as needed.

Furthermore, in these embodiments described above, both the protruding portions are provided along substantially the entire length of the groove. However, the present invention is not limited to such structures, and it is also possible to partially form such protruding portions along the longitudinal direction of the groove. In this connection, it is sufficient that such protruding portions are provided at least a portion of the groove in which the middle portion of the contact is placed.

Moreover, although in these embodiments described above, the protruding portions are provided along both sides of the groove, it is possible to provide such protruding portion on only one side of the groove. However, it is preferred that the protruding portions are provided on both sides of the groove. By adopting such a structure, it becomes possible to more stably hold the contact within the groove.

Moreover, the present invention can be applied to various connectors (male or female connectors) having a plurality of contacts and a contact holding member formed with a plurality of grooves for holding the contacts.

Moreover, in these embodiments, the movement of the contact is restricted by the protruding portions, however, the present invention is not limited to these embodiments, and it is also possible to restrict the movement of the contacts using means other than such protruding portions.

As has been described, the connector according to the present invention has a structure in that the movement of the contact is restricted by the abutment between the abutment surfaces of the contact and the abutment surfaces of the protruding portions. Therefore, there is no possibility that the contact will be displaced or disengaged from the groove even in the case where an external force is applied to the contact due to the contact with a contact of a mated connector.

Finally, the present invention is not limited to the embodiments described above, it goes without saying that various changes and modifications can be made without departing from the scope of the present invention which is determined by the following claims.

What is claimed is:

1. A connector, comprising:

at least one contact having a bottom surface side portions, and a top surface which acts as an electrical contact surface;

a contact holding member having a top surface in which at least one groove is formed wherein the groove is defined by a bottom surface and opposite sides wherein the contact is held in the groove by being inserted into the groove; and restriction means for restricting the movement of the contact in a direction away from the bottom surface of the groove, the restriction means including a pair of protruding portions which are provided in at least a part of the groove in the longitudinal direction thereof wherein the protruding portions are integrally formed on the opposite sides of the groove, respectively, and protrude so as to face with each other and to form an opening between tip parts thereof wherein each of the protruding portions is formed into a shape having a substantially triangular cross section defined by an upwardly slanting surface and a planar top surface which forms a continuous surface to the top surface of the contact holding member and wherein the contact is held in the groove in a state in which the bottom surface of the contact abuts on the bottom surface of the groove and the side portions of the contact are in point-contact with the tip parts of the protruding portions, respectively, so that at least a part of the contact surface protrudes above the protruding portions through the opening between the tip parts of the protruding portions.

2. The connector as claimed in claim 1 wherein the maximum width of the contact is larger than the interval between the tip parts of the protruding portions.

3. The connector as claimed in claim 1 wherein the side portions of the contact have slanting surfaces, respectively.

4. The connector as claimed in claim 1 wherein the side portions of the contact have curved surfaces, respectively.

* * * * *

UNITED STATES PATENT AND TRADEMARK OFFICE

CERTIFICATE OF CORRECTION

PATENT NO. : 6,659,804 B2
DATED : December 9, 2003
INVENTOR(S) : Nishio et al.

It is certified that error appears in the above-identified patent and that said Letters Patent is hereby corrected as shown below:

Title page,
Item [73], Assignee, change "Electronic" to -- Electric --

Signed and Sealed this

Twenty-ninth Day of June, 2004

JON W. DUDAS
*Acting Director of the United States Patent and Trademark Office*